US008238797B2

(12) United States Patent
Ishiguro et al.

(10) Patent No.: US 8,238,797 B2
(45) Date of Patent: Aug. 7, 2012

(54) TONER CARTRIDGE AND IMAGE FORMING APPARATUS USING THE SAME

(75) Inventors: Yasuyuki Ishiguro, Osaka (JP); Koichi Mihara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 115 days.

(21) Appl. No.: 12/827,194

(22) Filed: Jun. 30, 2010

(65) Prior Publication Data

US 2011/0002715 A1 Jan. 6, 2011

(30) Foreign Application Priority Data

Jul. 1, 2009 (JP) ..... 2009-157143

(51) Int. Cl.
*G03G 15/08* (2006.01)

(52) U.S. Cl. ..... 399/258; 399/263

(58) Field of Classification Search ..... 399/258, 399/262, 263
See application file for complete search history.

(56) References Cited

FOREIGN PATENT DOCUMENTS

| | | |
|---|---|---|
| JP | 2000-214667 A | 8/2000 |
| JP | 2005-227351 A | 8/2005 |
| JP | 2009-115885 | 5/2009 |

*Primary Examiner* — David Gray
*Assistant Examiner* — Erika J Villaluna
(74) *Attorney, Agent, or Firm* — Nixon & Vanderhye P.C.

(57) ABSTRACT

A toner cartridge includes: a toner storing portion for storing toner; a toner discharger having a toner discharge port; a screw auger having a rotary shaft and a helical blade for conveying the toner in the toner storing portion to the toner discharger; and an inner shutter that sections between the toner storing portion and the toner discharger. The inner shutter is provided so as to be movable to such a position as to create communication between the toner storing portion and the toner discharge port in linkage with rotation of the screw auger.

12 Claims, 5 Drawing Sheets

TONER CARTRIDGE AND IMAGE FORMING APPARATUS USING THE SAME

This Nonprovisional application claims priority under 35 U.S.C. §119 (a) on Patent Application No. 2009-157143 filed in Japan on 1 Jul. 2009, the entire contents of which are hereby incorporated by reference.

BACKGROUND OF THE TECHNOLOGY (1) Field of the Technology

The present technology relates to a toner cartridge for use in an image forming apparatus such as a laser beam printer, multifunctional machine or the like, in particular relating to a toner cartridge for storing toner such as a replaceable toner hopper, toner bottle, etc., as well as relating to an image forming apparatus using the cartridge.

(2) Description of the Prior Art

Conventionally, with demands for high quality and high-speed image printing, in the field of the image forming apparatuses such as copiers, facsimile machines and the like that use a dual-component developer, a toner cartridge, processor cartridge or the like is used to automatically supply toner to the developing unit to thereby perform continuous image printing.

In the thus configured image forming apparatus, when toner runs out, it is possible to supply toner in a simple manner by replacing the toner cartridge, process cartridge or the like. Toner cartridges for replacement are often stored in a storage or an empty space in a room, and may be stocked without their position regulated or may be oriented in every possible direction.

Accordingly, when toner cartridges of a type that discharges toner from one end are stacked and positioned vertically with the toner discharge port side down, the toner in the cartridge moves down due to gravity with the lapse of time, hence the toner around the toner discharge port becomes compact. As a result, there is a fear that the toner aggregates or becomes lumps, blocking the toner discharge port.

If the toner cartridge in this condition is newly mounted, toner is unlikely to be dispensed from the toner cartridge, and it could happen that it is determined that no toner remains in the toner cartridge even though a plenty amount of toner is left in the cartridge because no toner is discharged.

To deal with this situation, when a new toner cartridge is mounted to the image forming apparatus, it is requested for the user to mount the toner cartridge after shaking the cartridge several times. However, this has not brought about a complete solution of the above problem.

Particularly, since recent toner is improved in low-temperature fusing performance for the purpose of energy saving, the toner presents low storage stability in exchange and shows a stronger tendency to easily cause toner aggregation when the toner cartridge has been left as it is.

Besides, since recent image forming apparatuses have been demanded to be compact, the toner cartridge and the developing device are also made smaller in size and reduced in their mounting space. Accordingly, if the same amount of toner is stored, the toner needs to be packed in the downsized storing space, hence this further increases the possibility of toner aggregation.

Further, as is often the case, the user or the operator tends to forget to shake the toner cartridge before mounting the toner cartridge that has been preserved in a storage into an image forming apparatus. As a result, there occurs the case that the toner will not be dispensed due to toner aggregation inside the toner cartridge, causing troubles such as insufficient toner concentration in the developer and/or stoppage of the operation of the whole image forming apparatus.

On the other hand, as a conventional technique for preventing toner aggregation that would occur around the toner discharge port of the toner cartridge, a developer feeder has been disclosed (see patent document 1 (Japanese Patent Application Laid-open 2000-214667), in which part of the conveyor spiral of the conveying auger is cut off around the toner discharge port of the toner cartridge so as to enlarge the volume of the hollow space around the toner discharge port to thereby reduce the mechanical or thermal stress acting of the toner that is successively conveyed, on the toner at around the discharge port.

However, even with the toner cartridge of patent document 1, if the toner cartridge is left for long time with its toner discharge port down and resultantly the toner loses its fluidity (has become aggregated in some degree), the toner around the toner discharge port cannot be discharged out at the first action of toner supply after attachment to the image forming apparatus or when the toner conveying screw such as an auger screw or the like starts rotating. As a result, the toner to be discharged loses the place to go, and becomes compressed and packed by the pressure of toner conveying screw, causing the problem that toner conveying screwing is locked.

SUMMARY OF THE TECHNOLOGY

The present technology has been devised in view of the above conventional problem, it is therefore an object of the present technology to provide a toner cartridge that can prevent the toner conveying screw from being locked due to packing of the toner around the toner discharge port and achieve reliable toner supply as well as to provide an image forming apparatus using the same toner cartridge.

The toner cartridge according to the present technology for solving the above problem and the image forming apparatus using this toner cartridge are configured as follows:

The first aspect of the present technology resides in a toner cartridge comprising: a toner storing portion for storing toner; a toner discharger having a toner discharge port; a toner conveying screw (e.g., screw auger) having a rotary shaft and a helical blade for conveying the toner in the toner storing portion to the toner discharger; and, an inner shutter that sections between the toner storing portion and the toner discharger, and is characterized in that the inner shutter is provided so as to be able to be moved to such a position as to create communication between the toner storing portion and the toner discharge port in linkage with rotation of the toner conveying screw.

The second aspect of the present technology is characterized in that the inner shutter can be moved in the axial direction of the rotary shaft as the toner conveying screw rotates.

The third aspect of the present technology resides the above first or second configuration in which the toner discharger is formed with a peripheral wall that extends in the axial direction of the rotary shaft to define an approximately cylindrical interior space, the interior space is formed so that the cross-section that is perpendicular to the axis of the rotary shaft substantially corresponds to the contour of the inner shutter, and the toner discharge port is arranged in the peripheral wall.

The fourth aspect of the present technology resides the above third configuration in which the interior space is formed so that the cross-section has at least one angled corner.

The fifth aspect of the present technology resides in an image forming apparatus for forming images with toner based on electrophotography, comprising: a photoreceptor drum for forming an electrostatic latent image on the surface thereof; a developing unit for forming a toner image by supplying toner to the electrostatic latent image on the surface of the photoreceptor drum; a toner cartridge for supplying toner to the developing unit through a toner supply part; a transfer device for transferring the toner image on the photoreceptor drum surface to a recording medium; and, a fixing device for fixing the transferred toner image to the recording medium, and is characterized in that the toner cartridge defined in any one of the above first to fourth features is used as the toner cartridge.

According to the first aspect of the present technology, since the space of the toner discharger can be isolated by the inner shutter so that no toner will enter the area around the toner discharge port other than when toner need be supplied, it is possible to eliminate the risk of the toner around the toner discharge port being compressed by the pressure of the toner conveying screw and hence prevent the toner conveying screw from being locked due to toner solidification.

Further, since the toner discharge port is released (in other words, the interior of the toner storing portion is connected to the outside) in linkage with rotation of the toner conveying screw by moving the inner shutter to the downstream end of the toner conveying screw with respect to the toner conveying direction, it is possible to provide a compact toner cartridge with a simple structure without the necessity of providing a special mechanism for releasing the inner shutter.

According to the second aspect of the present technology, the inner shutter can be efficiently thrust downwards with respect to the toner conveying direction by the helical blade, it is possible to provide a simple and compact toner cartridge configuration without the necessity of providing a special mechanism for moving the inner shutter.

According to the third aspect of the present technology, since the toner discharge port is constructed so as to be released when the inner shutter has moved to the downstream end of the toner conveying screw with respect to the toner conveying direction in linkage with the rotation of the toner conveying screw, there is no obstacle that hinders the flow of toner from the toner storing portion to the toner discharge port, thus making it possible to achieve smooth toner supply.

According to the fourth aspect of the present technology, since the angled corner functions to inhibit the inner shutter from rotating, it is possible to prevent the inner shutter from rotating following the rotation of the toner conveying screw. Accordingly, it is possible to reliably open the inner shutter by making use of the rotation of the toner conveying screw.

According to the fifth aspect of the present technology, since it is possible to eliminate the risk of the toner around the toner discharge port being compressed by the pressure of the toner conveying screw and hence prevent the toner conveying screw from being locked due to toner solidification, it is possible to achieve reliable toner supply operation, and hence realize high-quality image output in a stable manner.

DESCRIPTION OF THE PREFERRED EMBODIMENTS

Now, the mode for carrying out the present technology will be described with reference to the drawings.

Figure 1:
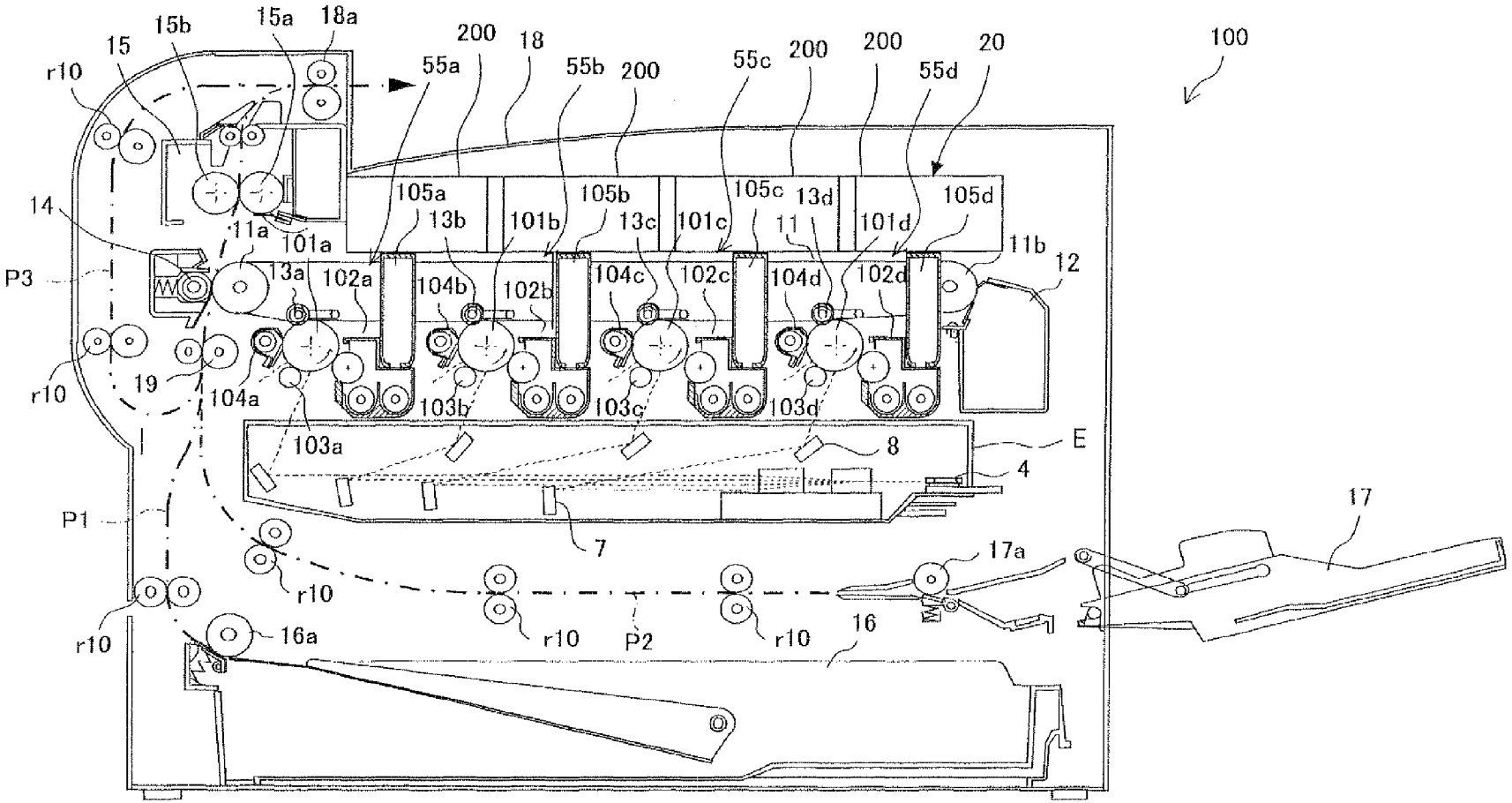
FIG. 1 is an illustrative view showing the overall configuration of an image forming apparatus in which a toner cartridge according to the embodiment of the present technology is used.

FIG. 1 shows one exemplary embodiment of the present technology, and is an illustrative view showing the overall configuration of an image forming apparatus in which a toner cartridge according to the embodiment of the present technology is used.

An image forming apparatus 100 according to the present embodiment forms an image with toners based on electrophotography, including: as shown in FIG. 1, photoreceptor drums 101*a*, 101*b*, 101*c* and 101*d* (which may also be called "photoreceptor drums 101" when general mention is made) for forming electrostatic latent images on the surfaces thereof; developing units 102*a*, 102*b*, 102*c* and 102*d* (which may also be called "developing units 102" when general mention is made) that supply toners to respective electrostatic latent images on photoreceptor drum 101 surfaces to form toner images; toner cartridges 200 which supply toner to developing units 102 through toner supply pipes (toner supply parts) 105*a*, 105*b*, 105*c* and 105*d* (which may also be called "toner supply pipes 105" when general mention is made); a secondary transfer roller (transfer device) 14 for transferring the toner images on photoreceptor drum 101 surfaces to the paper by way of an intermediate transfer belt 11; and a fixing unit 15 for fixing the transferred toner image to the paper.

To being with, the overall configuration of image forming apparatus 100 according to the present embodiment will be described.

Image forming apparatus 100 of the present embodiment forms a visual image printout of a multi-colored or monochrome image on a predetermined sheet (recording paper) in accordance with image data contained in an input command, such as image data and the like transmitted from the outside by way of a communication network or the like.

This image forming apparatus 100 includes: as shown in FIG. 1, an exposure unit E; photoreceptor drums 101 (101*a* to 101*d*) corresponding to image bearers on which latent images are formed by the exposure unit E; developing units 102 (102*a* to 102*d*); charging rollers 103*a* to 103*d* (which may also be called "charging rollers 103" when general mention is made); cleaning units 104*a* to 104*d* (which may also be called "cleaning units 104" when general mention is made); intermediate transfer belt 11; primary transfer rollers 13*a* to 13*d* (which may also be called "primary transfer rollers 13" when general mention is made); secondary transfer roller 14; fixing unit 15; paper feed paths P1, P2 and P3; a paper feed cassette 16; a manual paper feed tray 17; a paper output tray 18; a toner cartridge unit 20.

The image data for color images handled in this image forming apparatus 100 is formed of image data of four colors, i.e., black (K), cyan (C), magenta (M) and yellow (Y), and each of image forming portions 55*a* to 55*d* (which may also be called "image forming portions 55" when general mention is made) forms a visual image with toner of a color that corresponds to the color image data.

Accordingly, four developing units 102 (102*a* to 102*d*), photoreceptor drums 101 (101*a* to 101*d*), charging rollers 103 (103*a* to 103*d*) and cleaning units 104 (104*a* to 104*d*) are provided so as to form four latent images corresponding to four different colors.

All the image forming portions 55*a* to 55*d* have the same configurations, for example black image forming portion 55*a* is composed of photoreceptor drum 101*a*, developing unit 102*a*, charging roller 103*a*, transfer roller 13*a* and cleaning unit 104*a* and the like. These image forming portions 55*a* to 55*d* are arranged side by side in the moving direction of intermediate transfer belt 11 (in the sub scan direction).

Here, the symbols a to d are used so that 'a' corresponds to black, 'b' to cyan, 'c' to magenta and 'd' to yellow. The devices designated by each symbol form one imaging station, that is, four imaging stations are provided.

Exposure unit E as the light exposure device in the present embodiment includes an unillustrated semiconductor laser, a polygon mirror 4, a first reflecting mirror 7 and a second reflecting mirror 8, and illuminates photoreceptor drums 101*a* to 101*d* with light beams, i.e., laser beams, that are modulated based on image data of separate colors, that is, black, cyan, magenta and yellow.

Formed on photoreceptor drums 101*a* to 101*d* are electrostatic latent images based on image data of respective colors of black, cyan, magenta and yellow.

Though exposure unit E of the present embodiment is based on a technique using a laser scanning unit (LSU) equipped with a laser emitter and reflection mirrors, other methods using an array of light emitting elements such as an EL or LED writing head, for example may be used instead.

Photoreceptor drum 101 is an essentially cylindrical image bearer, which is arranged above exposure unit E, and is controlled by an unillustrated driving device and control device so as to rotate in a predetermined direction.

Photoreceptor drum 101 is composed of a base member and a photoconductive layer formed thereon. For example, the photoreceptor drum may be formed of a metallic base drum of aluminum or the like and a thin film of a photo conductive layer of amorphous silicon (a-Si), selenium (Se), organic photoconductor (OPC) or the like, formed on the outer peripheral surface of the base member. The configuration of photoreceptor drum 101 is not particularly limited to the above.

Charging roller 103 is a charging device of a contact type which uniformly electrifies the photoreceptor drum 101 surface at a predetermined potential. In the present embodiment, contact roller-type charging roller 103 is used as a charger as shown in FIG. 1, a charger of a corona discharging type or a brush type may be used instead of charging roller 103.

Developing unit 102 supplies toner to the photoreceptor drum 101 surface with an electrostatic latent image formed thereon to develop the electrostatic latent image into a toner image. Developing units 102*a* to 102*d* store black, cyan, magenta and yellow color toners, respectively so as to develop the electrostatic latent images for individual colors formed on photoreceptor drums 101*a* to 101*d* into toner images of black, cyan, magenta and yellow colors.

Cleaning unit 104 removes and collects the toner remaining on the photoreceptor drum 101 surface after development and image transfer, using a lubricant or the like.

Intermediate transfer belt 11 is arranged over photoreceptor drums 101, and formed of an endless film having a thickness of about 100 to 150 μm. This belt is wound and tensioned between a drive roller 11*a* and a driven roller 11*b*, forming a loop-like moving path.

Arranged opposing the outer peripheral surface of intermediate transfer belt 11 are photoreceptor drum 101*d*, photoreceptor drum 101*c*, photoreceptor drum 101*b* and photoreceptor drum 101*a* in the order mentioned.

Primary transfer rollers 13*a* to 13*d* are arranged at positions opposing respective photoreceptor drums 101*a* to 101*d* with this intermediate transfer belt 11 held therebetween. The areas where intermediate transfer belt 11 opposes photoreceptor drums 101*a* to 101*d* form respective primary transfer positions.

In order to transfer the toner images carried on the surfaces of photoreceptor drums 101*a* to 101*d* to intermediate transfer belt 11, each of primary transfer rollers 13*a* to 13*d* is applied by constant-voltage control at a primary transfer bias that has the opposite polarity to that of the static charge on the toner. With this arrangement, the toner images of individual colors formed on photoreceptor drums 101 (101*a* to 101*d*) are successively transferred one over the other to the outer peripheral surface of intermediate transfer belt 11 so that a full-color toner image is formed on the outer peripheral surface of intermediate transfer belt 11.

If image data involving only part of colors of yellow, magenta, cyan and black is input, among the four photoreceptor drums 101*a* to 101*d*, electrostatic latent images and hence toner images are formed only for the photoreceptor drums 101 that correspond to the colors of the input image data. For example, upon monochrome image forming, the electrostatic latent image and toner image for photoreceptor drum 101*a* corresponding to black color is formed, so that the black toner image alone is transferred to the outer peripheral surface of intermediate transfer belt 11.

Each of primary transfer rollers 13*a* to 13*d* is composed of a shaft formed of metal (e.g., stainless steel) having a diameter of 8 to 10 mm and a conductive elastic material (e.g., EPDM, foamed urethane, etc.,) coated on the shaft surface, and uniformly applies a high voltage to intermediate transfer belt 11 through the conducive elastic material. Though in the present embodiment, primary transfer rollers 13*a* to 13*d* are used as the transfer electrodes, brushes and the like can also be used in their place.

The toner image transferred to the outer peripheral surface of intermediate transfer belt 11 at each primary transfer position is conveyed as intermediate transfer belt 11 circulates to the secondary transfer station where the belt opposes secondary transfer roller 14.

During image forming, secondary transfer roller 14 is abutted with a predetermined nip pressure against the outer peripheral surface of intermediate transfer belt 11, in the area where the interior side of intermediate transfer belt 11 is supported by drive roller 11*a*. In order to make the nip pressure constant, either secondary transfer roller 14 or intermediate transfer belt drive roller 11*a* is formed of a hard material such as metal or the like while the other is formed of a soft material such as an elastic roller or the like (elastic rubber roller, foamed resin roller etc.).

When the paper fed from paper feed cassette 16 or manual paper feed tray 17 passes through the nip between secondary transfer roller 14 and intermediate transfer belt 11, a high voltage of a polarity (+) opposite to the polarity (−) of the static charge on the toner is applied to secondary transfer roller 14.

In this way, the electrostatic latent images formed on photoreceptor drums 101 (101*a* to 101*d*) are visualized with the corresponding color toners, forming respective toner images, which are transferred to intermediate transfer belt 11 in a layered manner.

Then the thus layered toner image is moved as intermediate transfer belt 11 circulates to the contact position between the paper being conveyed and intermediate transfer belt 11, so that the toner image is transferred from the outer peripheral surface of intermediate transfer belt 11 to the paper by means of secondary transfer roller 14.

Since, of the toner adhering to intermediate transfer belt 11 as the belt comes in contact with photoreceptor drums 101, the toner which has not been transferred from intermediate transfer belt 11 to the paper during transfer of the toner image and remains on intermediate transfer belt 11 would cause contamination of color toners at the next operation, it is removed and collected by an intermediate transfer belt cleaning unit 12.

Intermediate transfer belt cleaning unit 12 includes a cleaning blade, for example as a cleaning member that comes into contact with intermediate transfer belt 11. Intermediate transfer belt 11 is supported from its interior side by intermediate transfer belt driven roller 11*b*, at the portion where this cleaning blade is put in contact with intermediate transfer belt 11.

The paper with the toner image as a visual image transferred thereon is lead to fixing unit 15 having a heat roller 15*a* and a pressing roller 15*b* and undergoes heating and pressing processes while passing through and between heat roller 15*a* and pressing roller 15*b*. Thereby, the toner image as a visual image is firmly fixed to the paper surface. The paper with the toner image fixed thereon is discharged by a paper discharge roller 18*a* onto paper output tray 18.

Image forming apparatus 100 includes a paper feed path P1 that extends approximately vertically to convey the paper stored in paper feed cassette 16 to paper output tray 18 by way of the nip between secondary transfer roller 14 and intermediate transfer belt 11 and fixing unit 15.

Arranged along paper feed path P1 are a pickup roller 16*a* for delivering the paper from paper feed cassette 16, one sheet at a time, into paper feed path P1, conveying rollers r10 for conveying the delivered paper upwards, a registration roller 19 for leading the conveyed paper to the nip between secondary transfer roller 14 and intermediate transfer belt 11 at a predetermined timing and paper discharge roller 18*a* for discharging the paper to paper output tray 18.

Image forming apparatus 100 also incorporates a paper feed path P2 that extends from manual paper feed tray 17 to registration roller 19, having a pickup roller 17*a* and conveying rollers r10 arranged therealong. There is also another paper feed path P3 that extends from paper discharge roller 18*a* toward the upstream side of registration roller 19 in paper feed path P1.

Paper discharge roller 18*a* is adapted to be rotatable in both forward and reverse directions, and is rotated in the forward direction to discharge the paper to paper output tray 18 at the time of one-sided image forming for forming an image on one side of the paper and at the time of the second side image forming in duplex image forming for forming images on both sides.

On the other hand, at the time of the first side image forming in duplex image forming, paper discharge roller 18*a* is driven in the forward direction until the rear end of the paper passes by fixing unit 15 and then rotated in reverse while the roller is holding the rear end of the paper to lead the paper into paper feed path P3. Thereby, the paper with an image formed on the first side only during duplex image forming is lead to paper feed path P1 with its printed face down and its front edge inverted to the rear.

Registration roller 19 leads the paper that has been fed from paper feed cassette 16 or manual paper feed tray 17 or that has been conveyed through paper feed path P3, to the nip between secondary transfer roller 14 and intermediate transfer belt 11 at a timing synchronized with the rotation of intermediate transfer belt 11. For this purpose, registration roller 19 stops rotating when photoreceptor drums 101 and intermediate transfer belt 11 start to operate while the paper that was started to be fed or conveyed in advance of rotation of intermediate transfer belt 11 is stopped from moving in paper feed path P1 with its front end abutting against registration roller 19.

Thereafter, registration roller 19 starts to rotate at such a timing that the front edge of the paper and the front end of the toner image formed on intermediate transfer belt 11 meet each other at the position where secondary transfer roller 14 and intermediate transfer belt 11 come in press-contact with each other.

Here, when full-color image forming is performed using all the image forming portions 55*a* to 55*d*, primary transfer rollers 13*a* to 13*d* are adapted to abut intermediate transfer belt 11 against respective photoreceptor drums 101*a* to 101*d*.

On the other hand, when monochrome image forming is performed with image forming portion 55*a* alone, primary transfer roller 13*a* alone is adapted to abut intermediate transfer belt 11 against photoreceptor drum 101*a*.

Next, the characteristic configuration of toner cartridge 200 according to the present embodiment will be described in detail with reference to the drawings.

Figure 2:
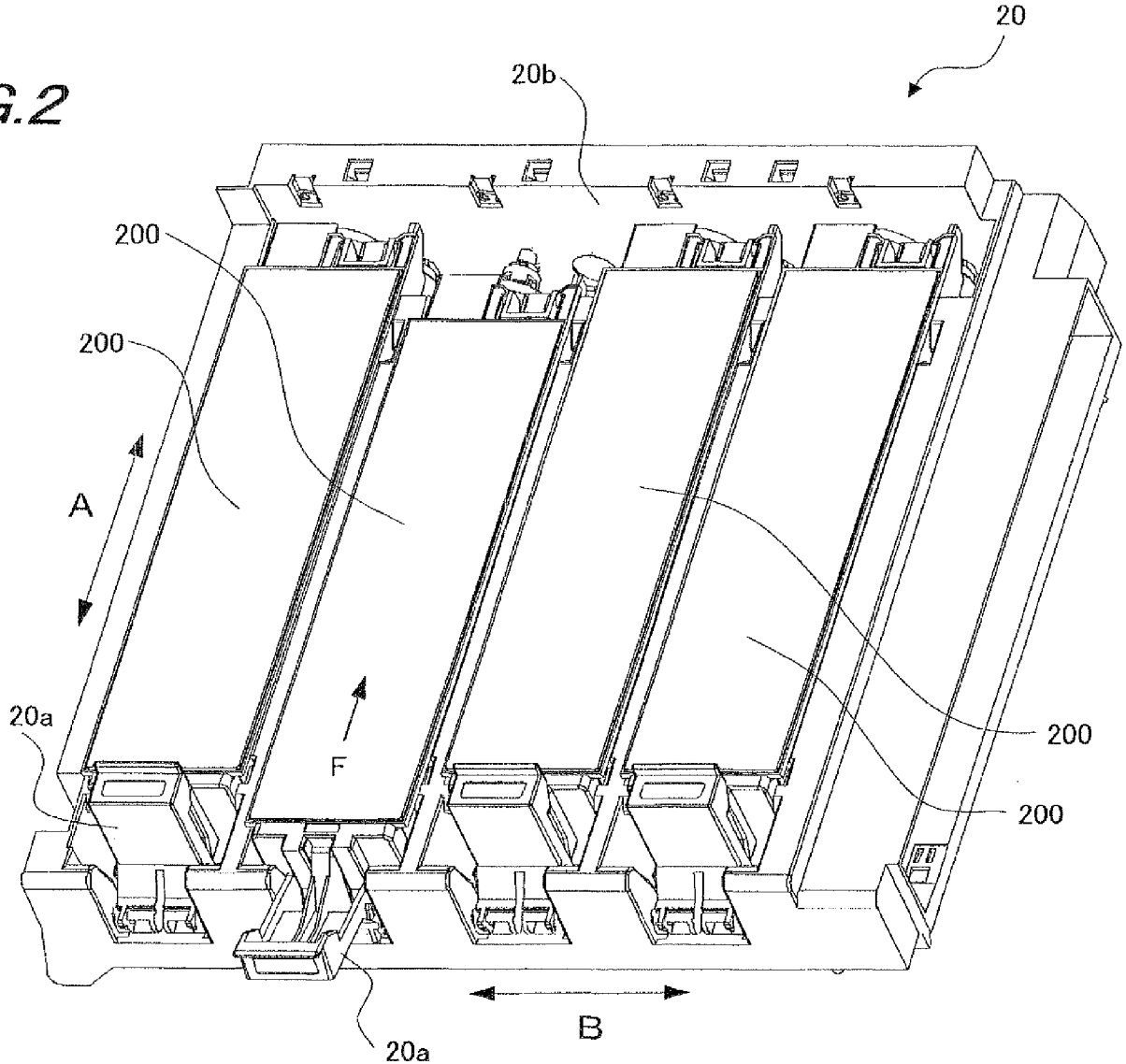
FIG. 2 is a perspective view showing the configuration of a toner cartridge unit including toner cartridges mounted in the image forming apparatus.
Figure 3A:
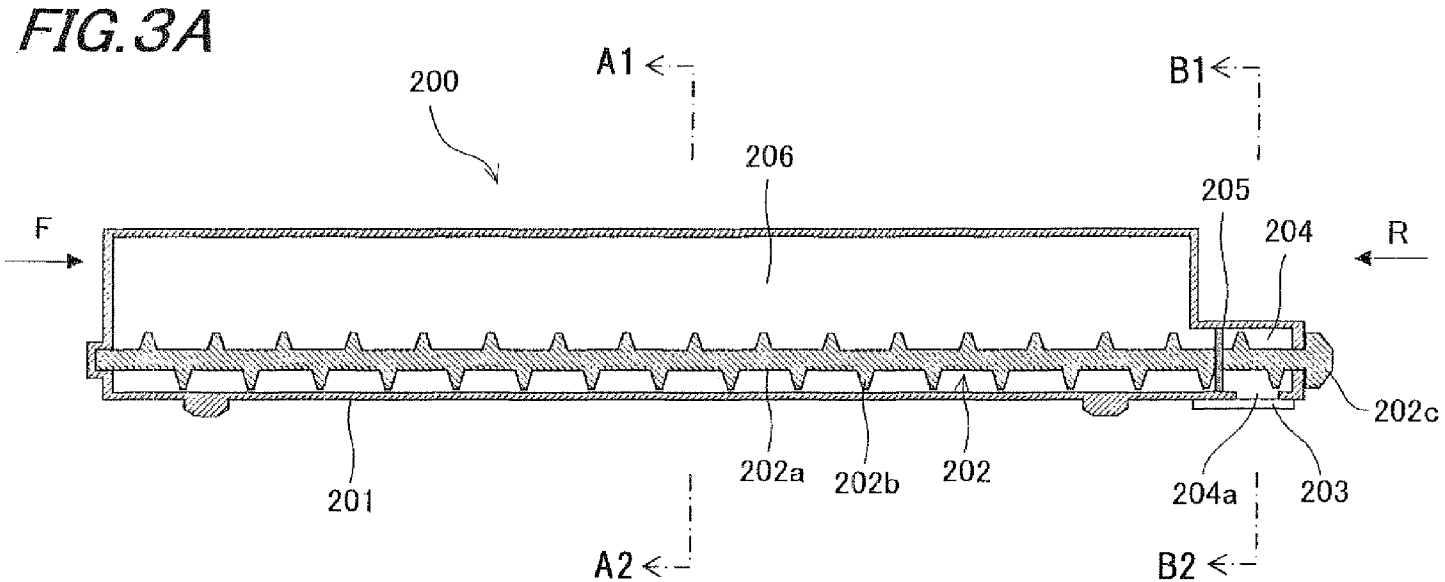
FIG. 3A is a sectional side view showing a state of the toner cartridge before the cartridge is mounted to the image forming apparatus.
Figure 3B:
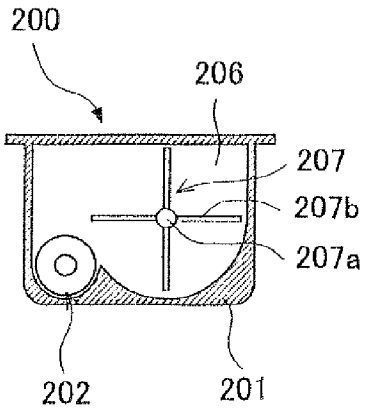
FIG. 3B is a sectional view cut along a plane A1-A2 in FIG. 3A.
Figure 3C:
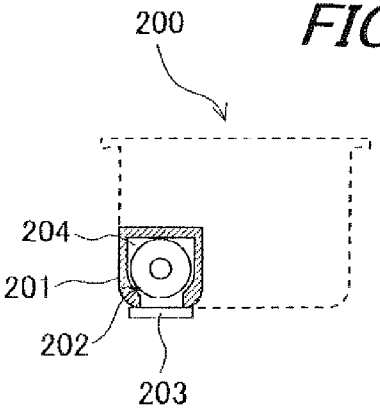
FIG. 3C is a sectional view cut along a plane B1-B2 in FIG. 3A.
Figure 4B:
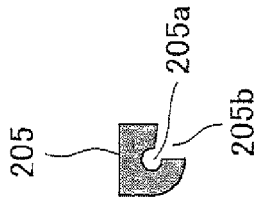
FIG. 4B is a front view showing the configuration of the inner shutter.
Figure 4A:
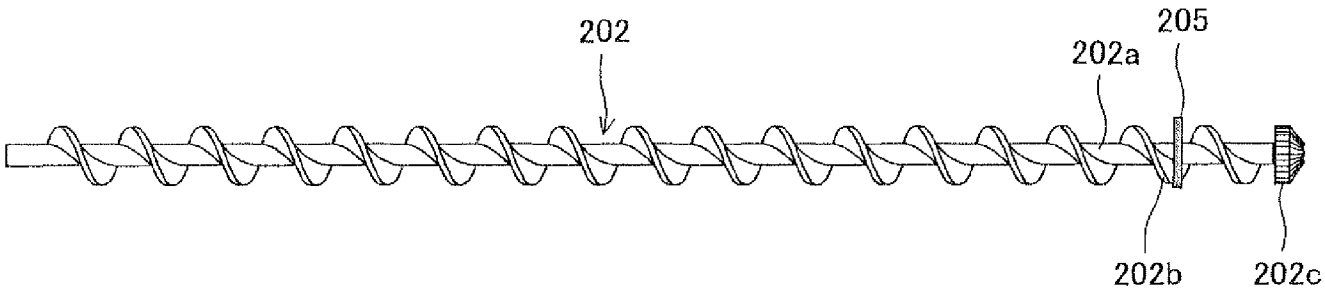
FIG. 4A is a side view showing the configuration of a screw auger and an inner shutter that constitute the toner cartridge.

FIG. 2 is a perspective view showing the configuration of a toner cartridge unit including toner cartridges mounted in the image forming apparatus according to the present embodiment. FIG. 3A is a sectional side view showing a state of the toner cartridge before the cartridge is mounted to the image forming apparatus. FIG. 3B is a sectional view cut along a plane A1-A2 in FIG. 3A. FIG. 3C is a sectional view cut along a plane B1-B2 in FIG. 3A. FIG. 4A is a side view showing the configuration of a screw auger and an inner shutter that constitute the toner cartridge. FIG. 4B is a front view showing the configuration of the inner shutter.

Here, FIG. 2 shows a state where one toner cartridge among the four has not been mounted.

As shown in FIG. 1, toner cartridge 200 according to the present embodiment is mounted to toner cartridge unit 20 provided in image forming apparatus 100.

Provided on the main body side of image forming apparatus 100 are a plurality of toner supply pipes (toner supply parts) 105 for leading the toner discharged from toner cartridges 200. Toner supply pipe 105 is arranged at such a position as to oppose an aftermentioned toner discharge port 204*a* of toner cartridge 200 when toner cartridge 200 has been mounted in toner cartridge unit 20.

Here, in the present embodiment, developing unit 102 is arranged under toner supply pipe 105 so that toner is supplied to developing unit 102 through the toner supply pipe 105. The toner supply pipes 105 are positioned outside intermediate transfer belt 11 with respect to the width direction of intermediate transfer belt 11 and arranged in series.

As shown in FIG. 2, toner cartridge unit 20 is provided in a top-open box form, in which four toner cartridges 200 including four color toners, i.e. black (K), cyan (C), magenta (M) and yellow (Y) toners, respectively are accommodated.

Each toner cartridge 200 is formed to be long along the intermediate transfer belt's width direction (the direction of arrow A). These toner cartridges are disposed side by side along the intermediate transfer belt's direction of conveyance (the direction of arrow B) at respective positions opposing developing units 102 (102*a* to 102*d*).

Toner cartridge unit 20 includes a stopper plate 20*b* disposed along one side that extends in the intermediate transfer belt's direction of conveyance so as to position toner cartridges 200, and lock levers 20*a* disposed on the opposite side to shift respective toner cartridges 200 toward stopper plate 20*b* side and hold them.

Lock lever 20*a* is laid down sideward when toner cartridge 200 is simply put. To mount toner cartridge 200 into toner cartridge unit 20 in a usable manner, lock lever 20*a* is set upright so as to move toner cartridge 200 in the direction of arrow F and hold the toner cartridge by its being abutted against stopper plate 20*b*.

Figure 5A:
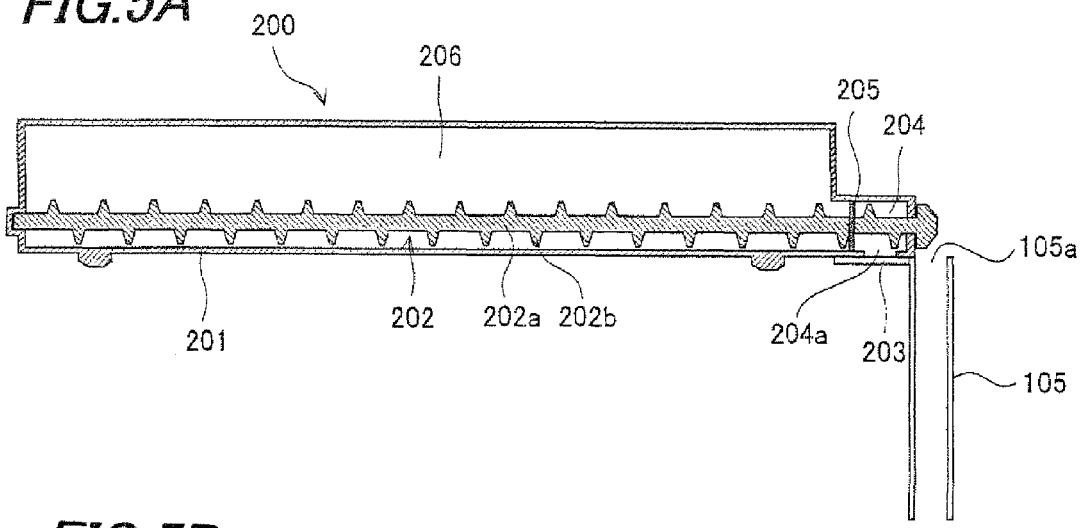
FIG. 5A is an illustrative view showing a state of a toner cartridge according to the embodiment immediately before the toner cartridge is mounted to the image forming apparatus.
Figure 5B:
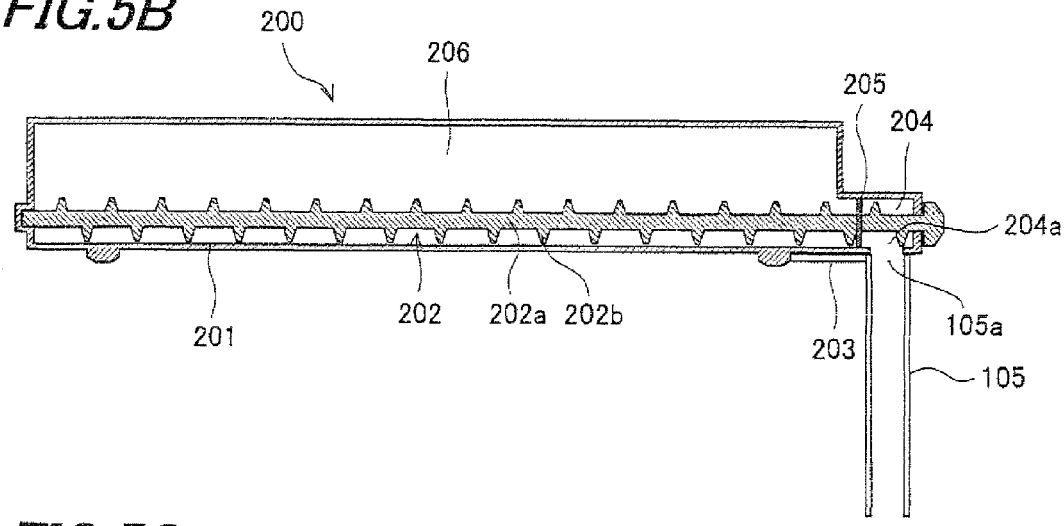
FIG. 5B is an illustrative view showing a state of the toner cartridge according to the embodiment immediately after the toner cartridge has been mounted to the image forming apparatus; and, FIG. 5C is an illustrative view showing a state of the toner cartridge after the toner cartridge has been mounted to the image forming apparatus and the screw auger is started rotating.
Figure 5C:
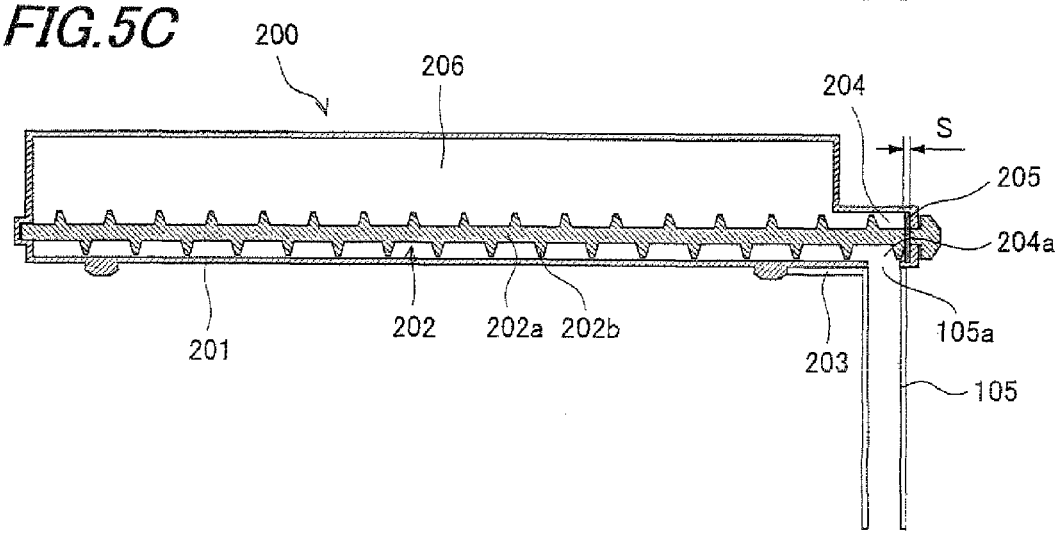

When toner cartridge 200 is mounted into toner cartridge unit 20, an outer shutter 203 moves in an approximately horizontal direction as a toner container 201 moves in an approximately horizontal direction relative to toner supply pipe 105, as shown in FIGS. 5A to 5C. Then, when the toner cartridge has been set at the position where toner discharge port 204*a* opposes toner supply pipe 105, the toner discharge port 204*a* is released so that toner can be supplied from the top of toner supply pipe 105.

As shown in FIGS. 3A, 3B and 3C, toner cartridge 200 includes toner container (toner storing portion) 201 for storing toner, a screw auger (toner conveying screw) 202, toner discharge port 204*a*, outer shutter 203, an inner shutter 205 and an agitating paddle 207. Here, symbols 'F' and 'R' in FIG. 3 designate the positional relationship for attachment of toner cartridge 200 in image forming apparatus 100, 'F' representing the near side (control side) of image forming apparatus 100 and 'R' the far side of image forming apparatus 100.

As shown in FIG. 3A, toner container 201 includes a toner storing portion 206 that defines a box-shaped space having an approximately rectangular vertical section for storing toner therein. In one longitudinal end of the container, a toner discharger 204 defining an approximately cylindrical interior space having a vertical section that is arced in the bottom and rectangled in the top, is projectively formed outside from toner storing portion 206, as shown in FIG. 3C. Inside toner storing portion 206, screw auger 202 and agitating paddle 207 are rotatably supported parallel to each other, as shown in FIG. 3B.

Screw auger 202 includes a rotary shaft 202*a*, a helical blade 202*b* and a drive gear 202*c*. This screw auger is disposed in the bottom of toner container 201, extending from toner storing portion 206 to toner discharger 204. That is, screw auger 202 is located above toner discharge port 204*a*. Helical blade 202*b* turns so as to convey the toner inside toner container 201 toward toner discharge port 204*a*. Drive gear 202*c* is projectively arranged outside toner discharger 204 so that drive force from an unillustrated motor provided for the image forming apparatus body is transferred thereto.

Agitating paddle 207 is an agitating member made up of a rotary shaft 207*a* disposed approximately parallel to screw auger 202 and four agitating blades 207*b* provided equiangularly around the rotary shaft 207*a* along the axis thereof. With this arrangement, the toner in toner storing portion 206 can be loosen up as agitating blades 207*b* rotate.

Toner discharge port 204*a* is rectangularly opened in the bottom of toner discharger 204 and discharges the toner conveyed by screw auger 202 out of toner cartridge 200.

Outer shutter 203 is formed of an approximately rectangular plate-like piece that opens and closes toner discharge port 204*a*, and is arranged on the outer side of toner container 201 so as to be slidable in the longitudinal direction toner container 201. In the usual state, the outer shutter is urged by an unillustrated spring member or the like to the position that confines the toner discharge port 204*a*. When toner cartridge 200 has been mounted to image forming apparatus 100, this outer shutter releases toner discharge port 204*a* in linkage with the attachment action of toner cartridge 200.

Inner shutter 205 is a plate-like piece that is arced on the lower side and rectangled on the upper side, correspondingly to the vertical section of the interior space of toner discharger 204, as shown in FIGS. 3A, 3B, 4A and 4B.

Formed in inner shutter 205 in its flat plane are a round cutout 205*a* that corresponds to the perpendicular section (vertical section) of rotary shaft 202*a* of screw auger 202 and a sectorial cutout 205*b* that corresponds to the perpendicular section (vertical section) of helical blade 202*b* of screw auger 202.

This inner shutter 205 is arranged inside toner discharger 204 so as to separate the interior space into toner storing portion 206 and toner discharger 204. That is, inner shutter 205 functions as a partitioning wall between toner storing portion 206 and toner discharger 204.

Further, inner shutter 205 is arranged so as to be moved inside toner discharger 204 along the axial direction of rotary shaft 202*a* by helical blade 202*b* that turns and moves as screw auger 202 rotates. At this time, since the upper rectangled portion of inner shutter 205 impedes rotation of the inner shutter, the inner shutter can be prevented from rotating (turning together) following the rotation of the toner conveying screw.

In addition, inner shutter 205 is disposed inside toner discharger 204 at a position close to toner storing portion 206 in such a manner as to come into close contact with both the peripheral wall of toner discharger 204 and the periphery of screw auger 202, whereby the inner shutter functions as a sealing member in toner cartridge 200 before its attachment to image forming apparatus 100 so that the toner on the toner storing portion 206 side will not enter the toner discharger 204 side.

The thus configured toner cartridge 200 is set over each developing unit 102 and connected to toner supply pipe 105 to supply toner to developing unit 102, as shown in FIG. 1. Before toner cartridge 200 is mounted to the apparatus body, inner shutter 205 blocks the toner inside toner container 201 so that no toner will enter toner discharger 204.

Next, the attachment work and operation when toner cartridge 200 is mounted to image forming apparatus 100 according to the present embodiment will be described.

FIG. 5A is an illustrative view showing a state of the toner cartridge according to the present embodiment immediately before the toner cartridge is mounted to the image forming apparatus. FIG. 5B is an illustrative view showing a state of the same toner cartridge immediately after the toner cartridge has been mounted to the image forming apparatus. FIG. 5C is an illustrative view showing a state of the same toner cartridge after the toner cartridge has been mounted to the image forming apparatus and the screw auger is started rotating.

When toner cartridge 200 to be mounted to image forming apparatus 100 is put alone (for instance, when the cartridge is kept in storage as an individual item), inner shutter 205 is located inside toner discharger 204 at a position upstream of toner discharge port 204*a* with respect to the toner conveying direction while outer shutter 203 is located at such a position as to confine toner discharge port 204*a*, as shown in FIG. 3A.

When toner cartridge 200 is mounted to image forming apparatus 100, outer shutter 203 abuts toner supply pipe 105 that is located in the course of insertion and is stopped from entering, immediately before completion of attachment as shown in FIG. 5A.

Then, until toner cartridge 200 is inserted to the predetermined position of image forming apparatus 100 and completely attached, outer shutter 203 collides with toner supply pipe 105 and is stopped to advance while toner cartridge 200 is inserted to the predetermined position, as shown in FIG. 5A. Accordingly, outer shutter 203 relatively moves in the direction opposite to the direction in which toner cartridge 200 is inserted, so as to release toner discharge port 204*a*. At the same time, toner discharge port 204*a* and toner supply port 105*a* of toner supply pipe 105 coincide with each other when viewed from top, establishing communication. At this point of time, the toner inside toner cartridge 200 remains dammed up by inner shutter 205.

When a toner supply operation by toner cartridge 200 begins, screw auger 202 rotates so that inner shutter 205 is pushed by helical blade 202*b* and moved downstream with respect to the toner conveying direction (toward the toner discharge port 204*a* side with respect to the direction (axial direction) in which the axis of rotary shaft 202*a* extends).

When inner shutter 205 has been conveyed passing over toner discharge port 204*a* to the downstream end of screw auger 202 with respect to the toner conveying direction, the interior of toner storing portion 206 and toner supply pipe 105 establish the maximum communication so that toner can be supplied most efficiently from toner discharge port 204*a* to toner supply pipe 105.

In toner discharger 204, in order to prevent inner shutter 205 that has been conveyed to the downstream end of screw auger 202 with respect to the toner conveying direction, from impeding the rotational operation of screw auger 205, a shutter storage space having a width S that corresponds to the thickness of inner shutter 205 is provided between the downstream end of helical blade 202*b* with respect to the toner conveying direction and the interior wall of toner discharger 204, as shown in FIG. 5C.

This can eliminate the risk of screw auger 202 being locked by preventing internal shutter 205 from hindering the rotational operation of the screw auger.

According to the present embodiment thus configured as above, toner container 201 of toner cartridge 200 includes inner shutter 205 for sectioning the interior space thereof into toner storing portion 206 and toner discharger 204, and this inner shutter 205 is configured so as to be able to move in linkage with rotation of screw auger 202, to the position where communication between toner storing portion 206 and toner discharge port 204*a* is created, whereby the interior space of toner discharger 204 can be isolated by inner shutter 205 so that no toner will enter the area around toner discharge port 204*a* other than when toner need be supplied. Accordingly, it is possible to eliminate the risk of the toner around toner discharge port 204*a* being compressed by the pressure due to conveyance of screw auger 202 and hence prevent screw auger 202 from being locked due to toner solidification. This enables toner cartridge 200 to achieve reliable toner supply operation, and hence can realize high-quality image output in a stable manner.

Alternatively, there is a case where toner cartridge 200 is shaken well right before its attachment to image forming apparatus 100 in order to improve fluidity of toner inside toner cartridge 200. At this case, the conventional toner cartridge has the trouble that the toner takes an aerosol form (becomes a gaseous suspension of toner) and floods out into the developing unit side the moment the outer shutter is opened. In contrast, since toner cartridge 200 of the present embodiment has inner shutter 205, it is possible to prevent the toner from flooding out, hence prevent image fogging due to increase in toner concentration and avoid toner scattering from developing unit 102.

Further, according to the present embodiment, since inner shutter 205 is moved to the downstream end of screw auger 202 with respect to the toner conveying direction by the thrust of the shutter as a result of the rotation of helical blade 202*b* of screw auger 202, it is possible to configure a compact toner cartridge 200 with a simple structure without the necessity of providing a special mechanism for releasing inner shutter 205.

Further, according to the present embodiment, the interior space of toner discharger 204 is formed so that its vertical section that is perpendicular to the axis of rotary shaft 202*a* substantially corresponds to the contour of inner shutter 205 and toner discharge port 204*a* is arranged in the bottom of the peripheral wall of toner discharger 204 while inner shutter 205 is moved to the aforementioned shutter storage space by rotation of screw auger 202 so as to open toner discharge port 204*a* to the maximum. Accordingly, there is no obstacle that hinders the flow of toner from toner storing portion 206 to toner discharge port 204*a*, thus making it possible to achieve smooth toner supply.

Finally, according to the present embodiment, since the shutter storage space is provided in toner discharger 204, it is possible to prevent inner shutter 205 from hindering the rotational motion of screw auger 202 when inner shutter 205 has been moved to the downstream end of screw auger 202 with respect to the toner conveying direction.

Though the above embodiment was described taking an example in which the image forming apparatus of the present technology is applied to image forming apparatus 100 shown in FIG. 1, the technology can be developed to any other image forming apparatus and the like, not limited to the image forming apparatus and copier described above as long as the image forming apparatus is constructed to supply toner to the developing unit using a toner cartridge. For example, the technology can be applied to an image forming apparatus based on electrophotography that supports monochrome image forming only.

Having described heretofore, the present technology is not limited to the above embodiment, various changes can be made within the scope of the appended claims. That is, any embodied mode obtained by combination of technical means modified as appropriate without departing from the spirit and scope of the present technology should be included in the technical art of the present technology.

What is claimed is:

1. A toner cartridge comprising:

a toner storing portion for storing toner;

a toner discharger having a toner discharge port;

a toner conveying screw having a rotary shaft and a helical blade for conveying the toner in the toner storing portion to the toner discharger; and, an inner shutter that is initially located at a first position on the toner conveying screw such that the inner shutter separates the toner storing portion from the toner discharger, characterized in that rotation of the toner conveying screw causes the inner shutter to move along a longitudinal axis of the toner conveying screw to a second position that allows communication between the toner storing portion and the toner discharge port.

2. The toner cartridge according to claim 1, wherein when the toner conveying screw rotates, contact between the helical blade and the inner shutter causes the inner shutter to move between the first position and the second position.

3. The toner cartridge according to claim 2, wherein the toner discharger is formed with a peripheral wall that extends in the longitudinal axial direction of the rotary shaft to define an approximately cylindrical interior space, wherein the interior space is formed so that a cross-section that is perpendicular to the longitudinal axis of the rotary shaft substantially corresponds to the outer contour of the inner shutter, and wherein the toner discharge port is arranged in the peripheral wall.

4. The toner cartridge according to claim 3, wherein the interior space is formed so that the cross-section has at least one angled corner.

5. The toner cartridge according to claim 1, wherein the toner discharger is formed with a peripheral wall that extends in the longitudinal axial direction of the rotary shaft to define an approximately cylindrical interior space, wherein the interior space is formed so that a cross-section that is perpendicular to the longitudinal axis of the rotary shaft substantially corresponds to the exterior contour of the inner shutter, and wherein the toner discharge port is arranged in the peripheral wall.

6. The toner cartridge according to claim 5, wherein the interior space is formed so that the cross-section has at least one angled corner.

7. The toner cartridge according to claim 6, wherein the at least one angled corner of the interior space interacts with a corresponding angled corner on an exterior edge of the inner shutter to prevent the inner shutter from rotating with the toner conveying screw.

8. An image forming apparatus for forming images with toner based on electrophotography, comprising:

a photoreceptor drum for forming an electrostatic latent image on a surface thereof;

a developing unit for forming a toner image by supplying toner to the electrostatic latent image on the surface of the photoreceptor drum;

a toner cartridge for supplying toner to the developing unit through a toner supply part;

a transfer device for transferring the toner image on the photoreceptor drum surface to a recording medium; and, a fixing device for fixing the transferred toner image to the recording medium, characterized in that the toner cartridge defined in claim 1 is used as the toner cartridge.

9. The toner cartridge according to claim 1, wherein the second position corresponds to an end of the toner conveying screw.

10. The toner cartridge according to claim 9, wherein the helical blade does not extend all the way to the end of the toner conveying screw such that when the inner shutter is located at the second position, the presence of the inner shutter at the second position does not interfere with the helical blade to prevent the toner conveying screw from rotating.

11. The toner cartridge according to claim 1, wherein the inner shutter includes a round cutout that receive the shaft of the toner conveying screw and a sectorial cutout that extends from the round cutout.

12. The toner cartridge according to claim 1, wherein the inner shutter does not rotate with the toner conveying screw, and wherein the inner shutter is free to move along the longitudinal axis of the toner conveying screw.

* * * * *